US009427978B1

(12) United States Patent
Hokazono et al.

(10) Patent No.: US 9,427,978 B1
(45) Date of Patent: Aug. 30, 2016

(54) PRINTING DEVICE

(71) Applicant: Brother Kogyo Kabushiki Kaisha, Nagoya-shi, Aichi-ken (JP)

(72) Inventors: Takamine Hokazono, Kasugai (JP); Keiji Seo, Nagoya (JP); Hidenori Jo, Nagoya (JP); Yuki Nagashima, Nagoya (JP); Kenji Kurita, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/054,507

(22) Filed: Feb. 26, 2016

(30) Foreign Application Priority Data

Mar. 24, 2015 (JP) ..... 2015-060667

(51) Int. Cl.
*B41J 11/00* (2006.01)
*B41J 3/407* (2006.01)

(52) U.S. Cl.
CPC ..... *B41J 11/007* (2013.01); *B41J 3/4075* (2013.01)

(58) Field of Classification Search
CPC .... B41J 11/007; B41J 3/4075; B41J 11/006; B41J 11/0065; B41J 13/0054; B41J 13/103; B41J 13/106; B41J 13/12; B41J 13/18; B41J 13/223; B41J 13/226; B41J 13/24; B41J 13/32; B41J 15/044; B41J 15/048; B41J 15/18; B41J 17/02; B41J 17/18; B41J 17/20
See application file for complete search history.

(56) References Cited

U.S. PATENT DOCUMENTS

2002/0135622 A1* 9/2002 Kosaka ..... B41J 3/4075 347/104
2007/0019055 A1* 1/2007 Miyake ..... B41J 13/103 347/104
2015/0174933 A1* 6/2015 Kawajiri ..... B41J 15/16 347/104

FOREIGN PATENT DOCUMENTS

JP 2006-150857 A 6/2006
JP 2006-150858 A 6/2006
JP 2012-176498 A 9/2012

* cited by examiner

*Primary Examiner* — Kristal Feggins
(74) *Attorney, Agent, or Firm* — Banner & Witcoff, Ltd.

(57) ABSTRACT

A first roller is supported by the lid portion such that it can rotate. A second roller is provided such that it peels a label off of a release paper by nipping the release paper against the first roller. An elastic member is provided such that it switches a peeling mechanism from a first state to a second state. A moving portion is provided such that it switches the peeling mechanism from a second state to a third state by separating from a projecting portion in an open state and coming into contact with the projecting portion in a closed state. A first restricting portion is provided such that, when the peeling mechanism is in a fourth state, by coming into contact with the projecting portion and restricting the projecting portion from moving, it restricts the peeling mechanism from switching from the fourth state to the third state.

9 Claims, 17 Drawing Sheets

PRINTING DEVICE

CROSS-REFERENCE TO RELATED APPLICATION

This application claims priority to Japanese Patent Application No. 2015-060667 filed on Mar. 24, 2015, the disclosure of which is herein incorporated by reference in its entirety.

BACKGROUND

The present disclosure relates to a printing device.

A printing device is known that is able to switch between two different operating modes, hereinafter called the normal mode and the peel-off mode. The normal mode is an operating mode in which a printed label is discharged in a state in which it is affixed to a release paper. The peel-off mode is an operating mode in which the printed label is discharged in a state in which it has been peeled off of the release paper. With this sort of device, it is desirable for the operation that switches between the normal mode and the peel-off mode to be simple. For example, a label printer is known that is able to switch from the normal mode to the peel-off mode just by sliding a peeling unit. The peeling unit is provided with a slide portion, a peeling unit anchoring mechanism that locks the sliding operation of the slide portion, and a peeling roller. When switching from the normal mode to the peel-off mode, a user slides the peeling unit with a specified force. That releases the locking by the peeling unit anchoring mechanism. The user also slides the peeling unit to a peeling unit anchored position. The peeling unit is thus anchored by the peeling unit anchoring mechanism.

SUMMARY

In the label printer that is described above, when switching the operating mode from the normal mode to the peel-off mode, the peeling unit must be slid to the peeling unit anchored position by a manual operation.

Various embodiments of the general principles described herein provide a printing device that can easily switch from the normal mode to the peel-off mode.

Embodiments herein provide a printing device configured to perform printing on a label affixed to a release paper. The printing device is provided with a body portion, a lid portion, a first roller, a peeling mechanism, and a guide portion. The body portion is provided with a storing portion. The storing portion is configured to accommodate the release paper to which the label is affixed. The lid portion is supported by the body portion and is able to open and close the storing portion. The first roller is supported by the lid portion such that the first roller can rotate. The peeling mechanism is provided with a second roller and a projecting portion and is supported by the body portion such that a position of the second roller in relation to the first roller changes as the projecting portion moves. The second roller is provided such that it peels the label off of the release paper by nipping the release paper against the first roller. The projecting portion is provided such that it projects toward an outside. The guide portion is provided in the lid portion and is provided with a moving portion and a first restricting portion. The moving portion is configured such that it moves the projecting portion by coming into contact with the projecting portion in a closing process by which the lid portion changes from an open state to a closed state. The first restricting portion is configured such that it restricts the projecting portion from moving when the first restricting portion is in contact with the projecting portion in the closed state.

The peeling mechanism is configured such that it can be set selectively to a first state, a second state, a third state, and a fourth state. The first state is a state in which the second roller is separated from the first roller and the projecting portion is unable to come into contact with the moving portion in the closing process. The second state is a state in which the second roller is separated from the first roller and the projecting portion is able to come into contact with the moving portion in the closing process. The third state is a state in which a distance between the first roller and the second roller is shorter than the distance between the first roller and the second roller in the first state and the second state. The fourth state is a state in which the distance between the first roller and the second roller is shorter than the distance between the first roller and the second roller in the third state. The peeling mechanism is further provided with an elastic member. The elastic member is provided such that it energizes the second roller in a direction to switch the peeling mechanism from the first state to the second state. The moving portion is provided such that it switches the peeling mechanism from the second state to the third state by separating from the projecting portion in the open state and coming into contact with the projecting portion in the closed state. The first restricting portion is configured to restrict the peeling mechanism from switching from the fourth state to the third state, by coming into contact with the projecting portion and restricting the projecting portion from moving when the peeling mechanism is in the fourth state.

BRIEF DESCRIPTION OF THE DRAWINGS

Embodiments will be described below in detail with reference to the accompanying drawings in which.

DETAILED DESCRIPTION

Figure 1:
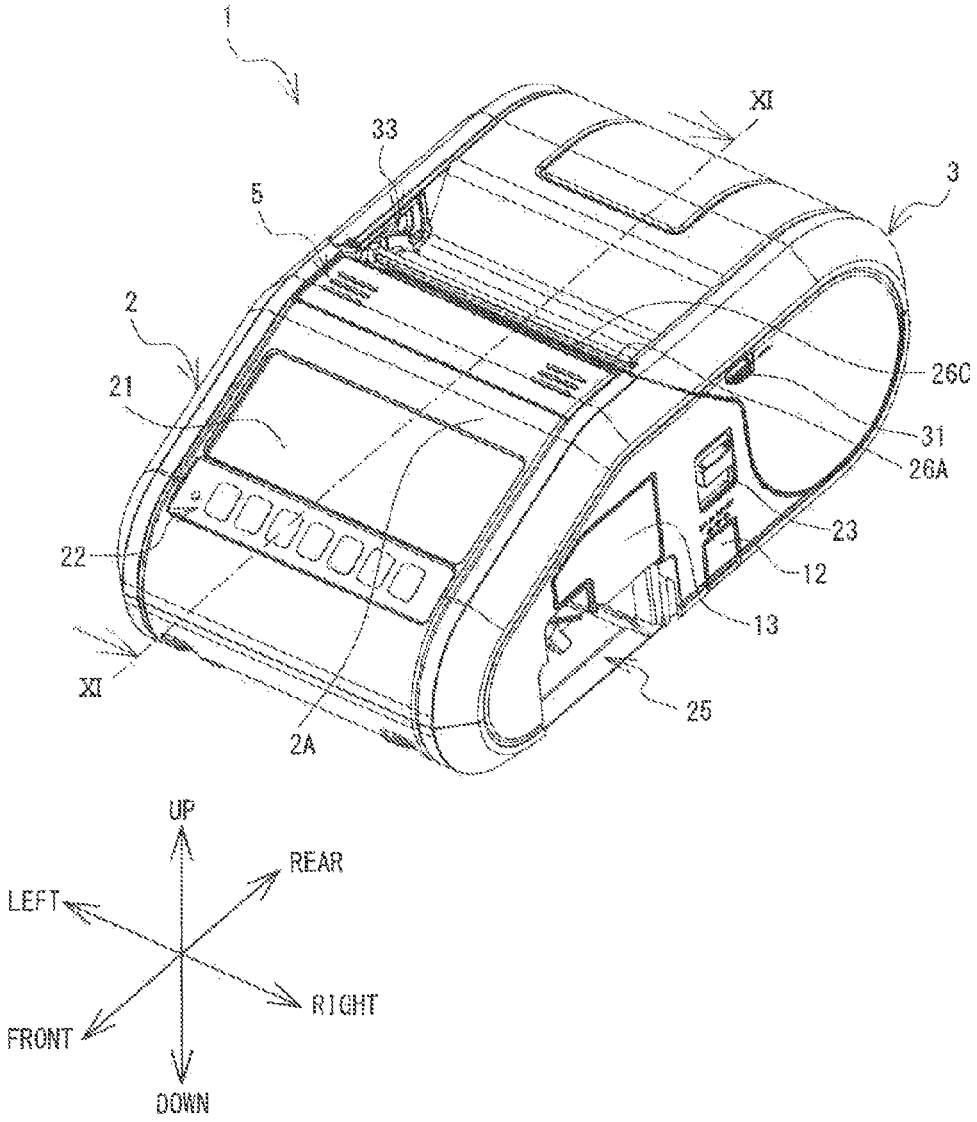
FIG. 1 is an oblique view of a printing device in a closed state.

The drawings that are hereinafter referenced are used for explaining technological features that the present disclosure can utilize. Device configurations and the like that are shown in the drawings are merely explanatory examples and do not serve to restrict the present disclosure to those configurations and the like. In the explanation that follows, the top side, the bottom side, the upper left side, the lower right side, the lower left side, and the upper right side in FIG. 1 respectively define the top side, the bottom side, the left side, the right side, the front side, and the rear side of a printing device 1.

An overview of the printing device 1 will be explained with reference to FIGS. 1 and 2. The printing device 1 can be connected to an external terminal (not shown in the drawings) through a USB (registered trademark) cable. The printing device 1 is capable of printing text characters, graphics, and the like on a label that is a printing medium, based on printing data that the printing device 1 has received from the external terminal. The label may be a heat-sensitive label, for example. The external terminal is a general-purpose personal computer (PC).

The printing device 1 is provided with a body 2, a lid portion 3, a peeling mechanism 5, and the like. In the body 2, a display portion 21 and switches 22 are provided on an inclined portion 2A toward the front of the top side. The display portion 21 displays various types of information. A user operates the printing device 1 by pressing the switches 22.

On its right side, the body 2 is provided with an electric power supply portion 12, an interface (I/F) 13, a mounting portion 25, a lever 23, and the like. The electric power supply portion 12 is a terminal for inserting a plug of an AC adaptor. The I/F 13 includes a plurality of terminals for inserting connectors of the USB (registered trademark) cable. The printing device 1 can communicate with the external terminal through the I/F 13. Note that in FIGS. 1 and 2 the electric power supply portion 12 and the I/F 13 are covered by rubber lids. A battery is mounted in the mounting portion 25. The printing device 1 is driven by a power supplied by the power supplying portion 12 or a power supplied by the battery that has been mounted in the mounting portion 25. Note that in FIG. 2 the mounting portion 25 is covered by a lid. The lever 23 will be described later.

Figure 2:
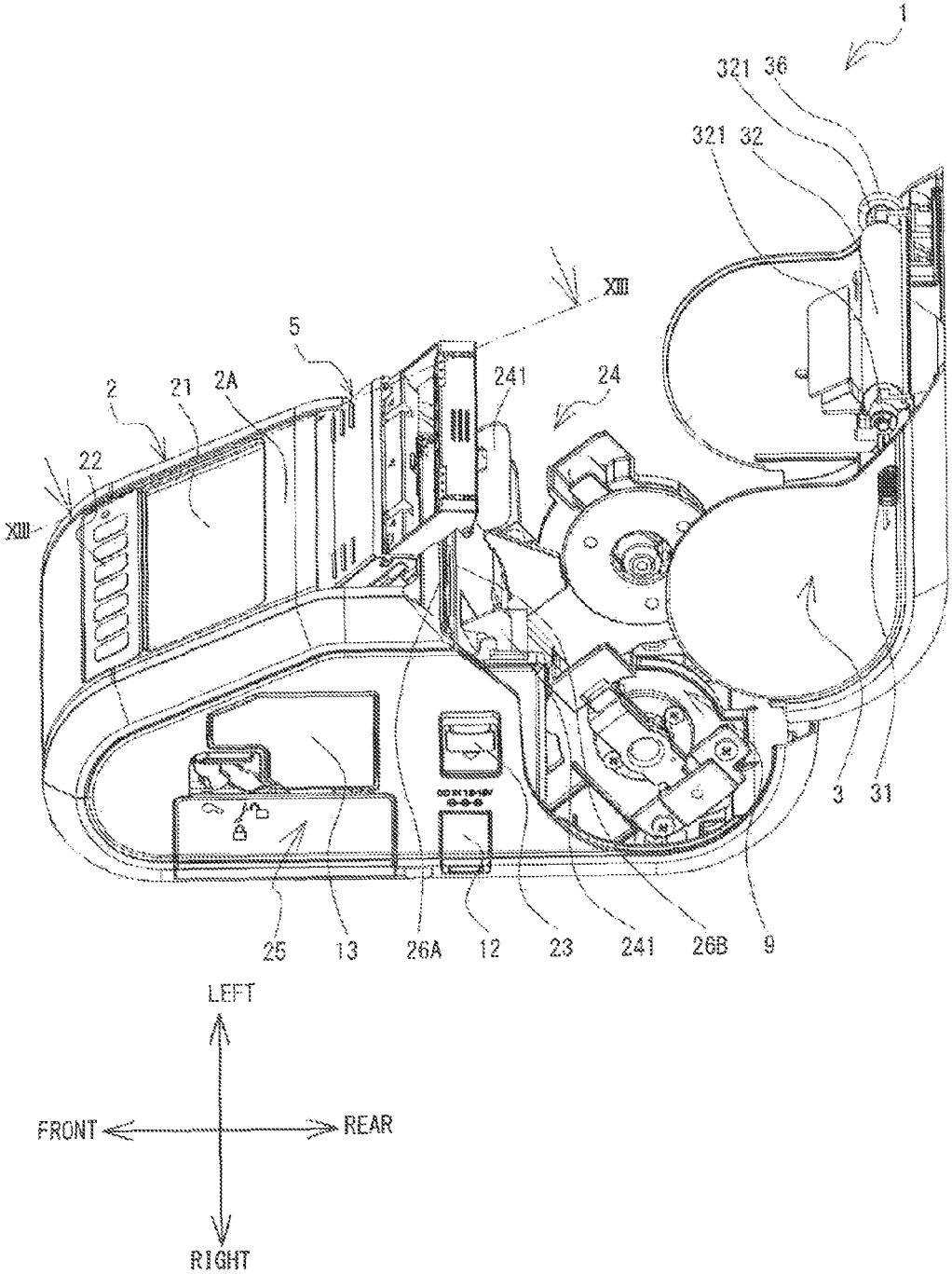
FIG. 2 is an oblique view of the printing device in an open state.

As shown in FIG. 2, a control portion (not shown in the drawings), a drive portion (not shown in the drawings), a storing portion 24, and the like are provided in the interior of the body 2. The control portion includes a CPU that controls the entire printing device 1. The drive portion is a motor for conveying a release paper to which the heat-sensitive label is affixed.

The storing portion 24 is a space that is able to accommodate a roll (not shown in the drawings) around which is wound the release paper to which the heat-sensitive label is affixed. Hereinafter, the release paper to which the heat-sensitive label is affixed will be called a tape. The left and right sides and the top side of the storing portion 24 are open. A paper holder 9 is fixed in place inside the storing portion 24. The paper holder 9 holds the roll. A cutting portion 26A is provided on the upper edge of a wall on the front side of the storing portion 24. The cutting portion 26A is a cutting edge that is able to cut away the printed portion of the tape. A printing portion 26B is provided below the cutting portion 26A. The printing portion 26B is a line thermal head that is able to perform printing on the heat-sensitive label. The cutting portion 26A and the printing portion 26B extend in the left-right direction.

The lid portion 3 is supported by the body 2 through a support shaft 29 (refer to FIG. 8) that is provided on the rear edge of the storing portion 24, such that the lid portion 3 can pivot around the support shaft 29. The lid portion 3 can pivot between a position where it covers the storing portion 24 from above and from the right side and the left side (refer to FIG. 1) and a position where it does not cover the storing portion 24 (refer to FIG. 2). Energizing portions 29A, which are springs, are wound around the support shaft 29 (refer to FIG. 8). The energizing portions 29A energize the lid portion 3 from the position where it covers the storing portion 24 toward the position where it does not cover the storing portion 24. Hereinafter, the state in which the lid portion 3 covers the storing portion 24, as shown in FIG. 1, will be called a closed state. The state in which the lid portion 3 does not cover the storing portion 24, as shown in FIG. 2, will be called an open state. The process of changing from the open state to the closed state will be called a closing process.

The edge of the lid portion 3 that is on the opposite side from the edge that is supported by the support shaft 29 supports a first roller 32 such that the first roller 32 can rotate. A rotating shaft of the first roller 32 extends in the left-right direction. A pair of engaged portions 321 extend outward to the left and the right from the left and right ends, respectively, of the rotating shaft of the first roller 32. Each one of the pair of the engaged portions 321 has a circular cylindrical shape. A gear 36 is provided on the left side of the engaged portion 321 on the left side.

The peeling mechanism 5 is supported by the body 2 on the rear side of the inclined portion 2A, such that the peeling mechanism 5 can pivot. In the closed state, as shown in FIG. 1, the printing portion 26B (refer to FIG. 2) and the first roller 32 (refer to FIG. 2) are close to one another, so a discharge outlet 26C is formed between the peeling mechanism 5 and the first roller 32. The tape is discharged from the discharge outlet 26C. The peeling mechanism 5 will be described in detail later.

Figure 3:
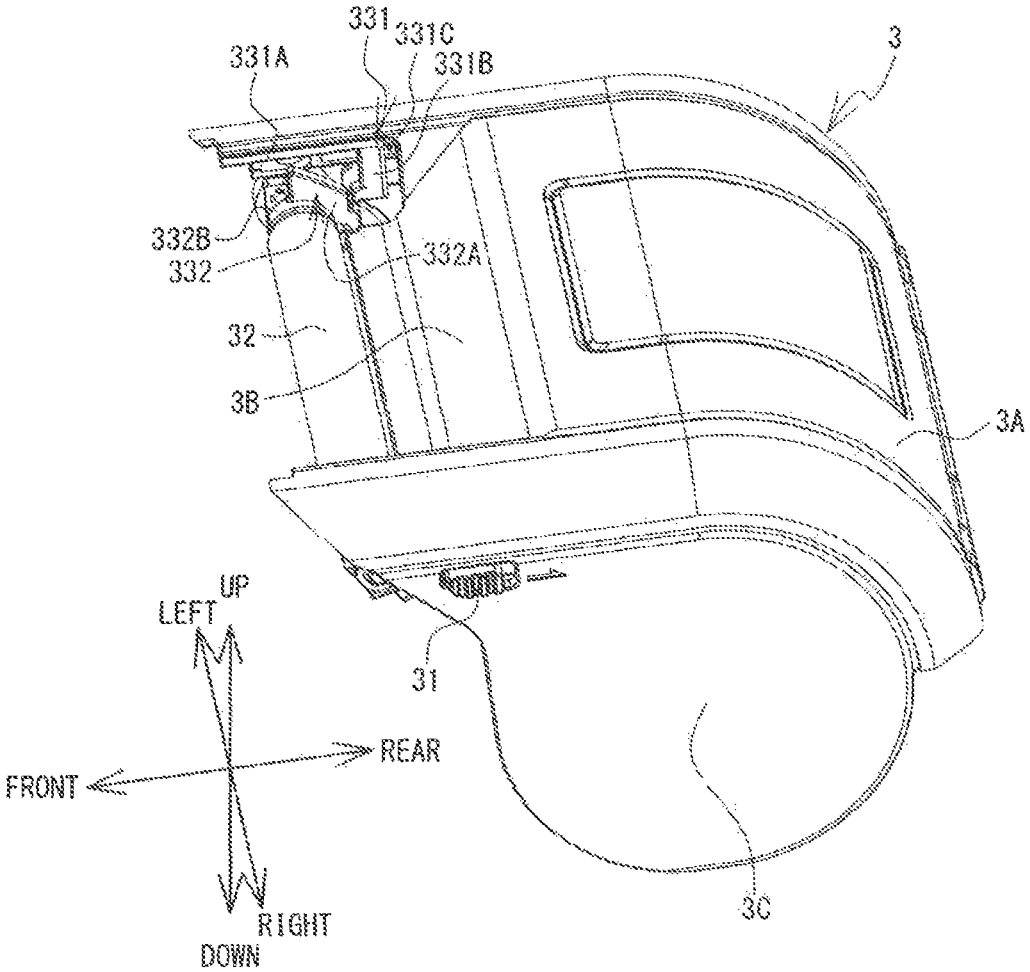
FIG. 3 is an oblique view of a lid portion.

The lid portion 3 will be described in detail with reference to FIG. 3. The lid portion 3 is provided with a first member 3A, a second member 3B, and a pair of third members 3C. The plate-shaped first member 3A extends in a curved shape from a portion that is supported by the support shaft 29 (refer to FIG. 8). In a section view, the plate-shaped second member 3B extends in a straight line toward the front in the closed state from one side of the first member 3A that is opposite side of the other side supported by the support shaft 29. The pair of the third members 3C are plate-shaped and are provided opposite one another on the left and right edges of the first member 3A and the second member 3B. In the closed state, the first member 3A and the second member 3B cover the top side of the storing portion 24 of the body 2. In the closed state, the pair of the third members 3C cover the left and right sides of the storing portion 24 of the body 2.

The explanation that follows will use the closed state as an example. The pair of the third members 3C support the first roller 32 from the left and the right at the front side of the second member 3B. Each one of the pair of the third members 3C is provided with a first guide portion 331 close to the portion that supports the first roller 32. Hereinafter, the first guide portion 331 that is provided on the third member 3C on the left side will be explained. The first guide portion 331 is provided with a moving member 331A, a first restricting member 331B, and a first energizing portion 331C. The bar-shaped moving member 331A extends in a straight line in the front-rear direction above the left end of the first roller 32. The first restricting member 331B extends downward in a straight line from the rear end of the moving member 331A. A projecting portion that projects slightly toward the front is provided on the lower end of the first restricting member 331B. The tip of the projecting portion of the first restricting member 331B is coming close to the rear edge of an extending portion 332A of a second guide portion 332 (described later) from the rear. The moving member 331A and the first restricting member 331B of the first guide portion 331 are able to move toward the front and the rear as a single unit. The first energizing portion 331C is provided on the rear side of the first restricting member 331B. The first energizing portion 331C is a compression spring that energizes the moving member 331A and the first restricting member 331B of the first guide portion 331 toward the front. The moving member 331A and the first restricting member 331B of the first guide portion 331 are connected to a lever 31 that is provided on the left face of the third member 3C on the left side. When the lever 31 is moved toward the rear, the moving member 331A and the first restricting member 331B of the first guide portion 331 move toward the rear against the energizing force of the first energizing portion 331C. The lower end of the first restricting member 331B thus moves away from the extending portion 332A of the second guide portion 332. Note that the first guide portion 331 that is provided in the third member 3C on the right side has the same shape as the first guide portion 331 that is described above, although it will not be described in detail.

The second guide portions 332 are provided at the left and right ends of the first roller 32. The second guide portions 332 are disposed close to the corresponding third members 3C. Hereinafter, the second guide portion 332 that is provided at the left end of the first roller 32 will be explained. The second guide portion 332 includes the extending portion 332A and an anchoring portion 332B. The anchoring portion 332B is provided to the left of the left end of the first roller 32. The anchoring portion 332B has a circular cylindrical shape whose cross-sectional shape is substantially the same as that of the first roller 32. The axial center of the anchoring portion 332B extends in the same direction as the rotational axis of the first roller 32. The extending portion 332A is a plate-shaped member that extends toward the upper front and the lower rear from a position between the top edge and the rear edge of a circumferential wall of the anchoring portion 332B. The rear edge of the extending portion 332A on the opposite side from the anchoring portion 332B slopes downward from the front toward the rear and is close to the lower edge of the first restricting member 331B. Note that the second guide portion 332 that is provided at the right end of the first roller 32 has the same shape as the second guide portion 332 that is described above, although it will not be described in detail.

Figure 4:
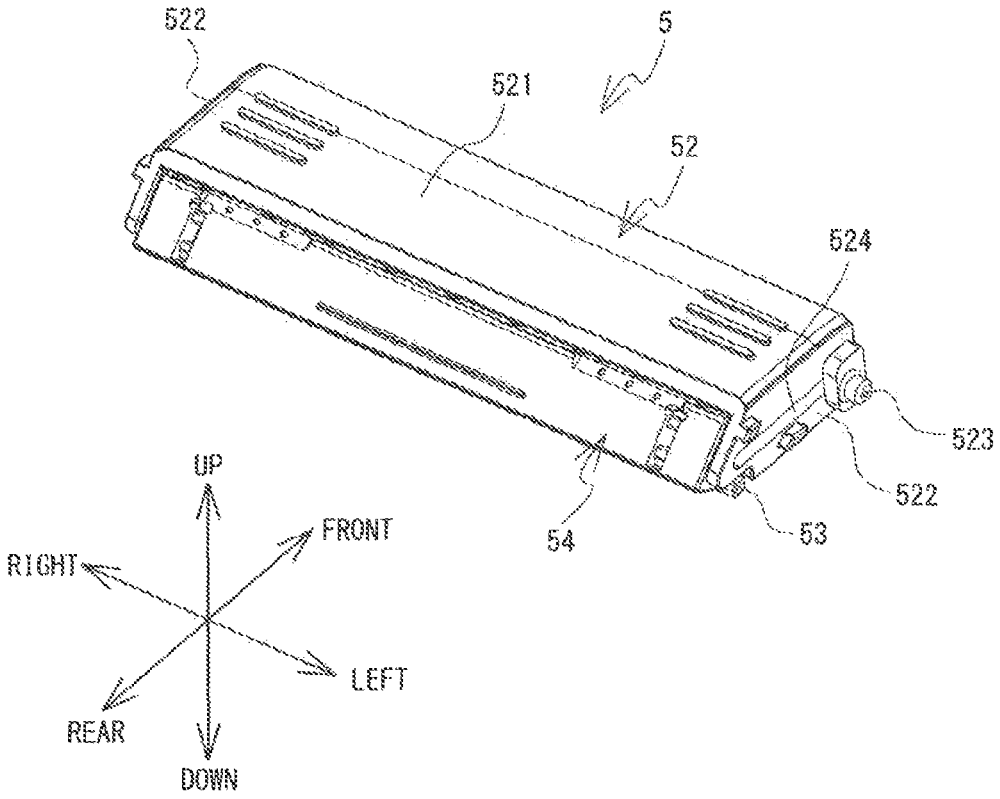
FIG. 4 is an oblique view of a peeling mechanism in which a support member is in a stored position, as seen from above.
Figure 5:
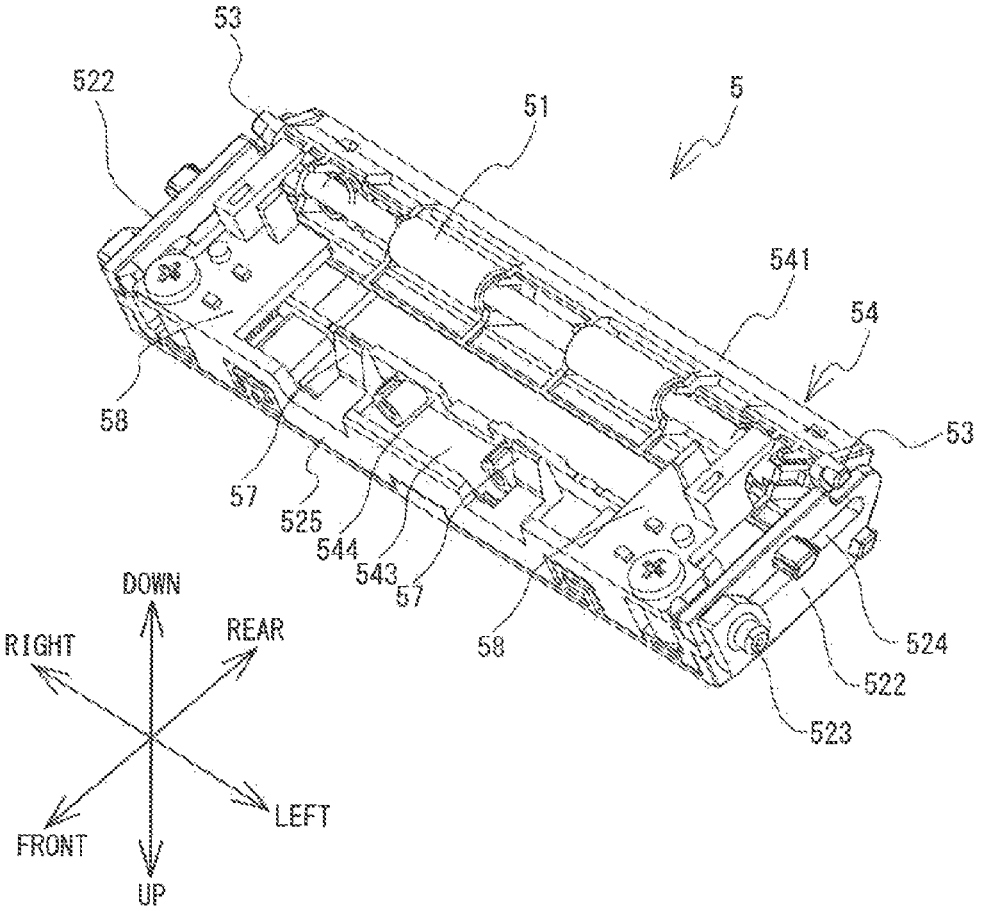
FIG. 5 is an oblique view of the peeling mechanism in which the support member is in the stored position, as seen from below.

The peeling mechanism 5 will be explained in detail with reference to FIGS. 4 to 7. As shown in FIG. 4, the peeling mechanism 5 is provided with a frame 52 and a support member 54. The frame 52 has a plate-shaped first member 521, a pair of second members 522, and a third member 525 (refer to FIG. 5). The shape of the first member 521 is a rectangle whose longitudinal axis extends in the left-right direction. The pair of the second members 522 extend downward from the left and right ends, respectively, of the first member 521. Circular cylindrical shaft portions 523 that protrude outward to the left and right are provided at the front ends of the pair of the second members 522. The shaft portions 523 support the peeling mechanism 5 on the body 2 (refer to FIG. 2) such that the peeling mechanism 5 can pivot. The explanation that follows uses a case in which the peeling mechanism 5 has pivoted to a state in which the plane of the first member 521 is horizontal (refer to FIG. 1) as an example. Each one of the pair of the second members 522 is provided with a long hole 524 that passes through the second member 522 in the left-right direction. The long holes 524 extend in the front-rear direction from near the front edges to near the rear edges of the second members 522. As shown in FIG. 5, the third member 525 is provided below the first member 521. The third member 525 includes a pair of anchoring portions 57 and a pair of spring holding portions 58. The pair of the anchoring portions 57 project downward from positions that are slightly outward, to the left and the right, from the left-right center of the third member 525. The pair of the spring holding portions 58 are wall portions that extend toward the rear from the left and right end portions of the third member 525. Each one of the pair of the spring holding portions 58 restricts the up-down movement of one of a pair of elastic members 55 (refer to FIG. 7), which are described below.

Figure 7:
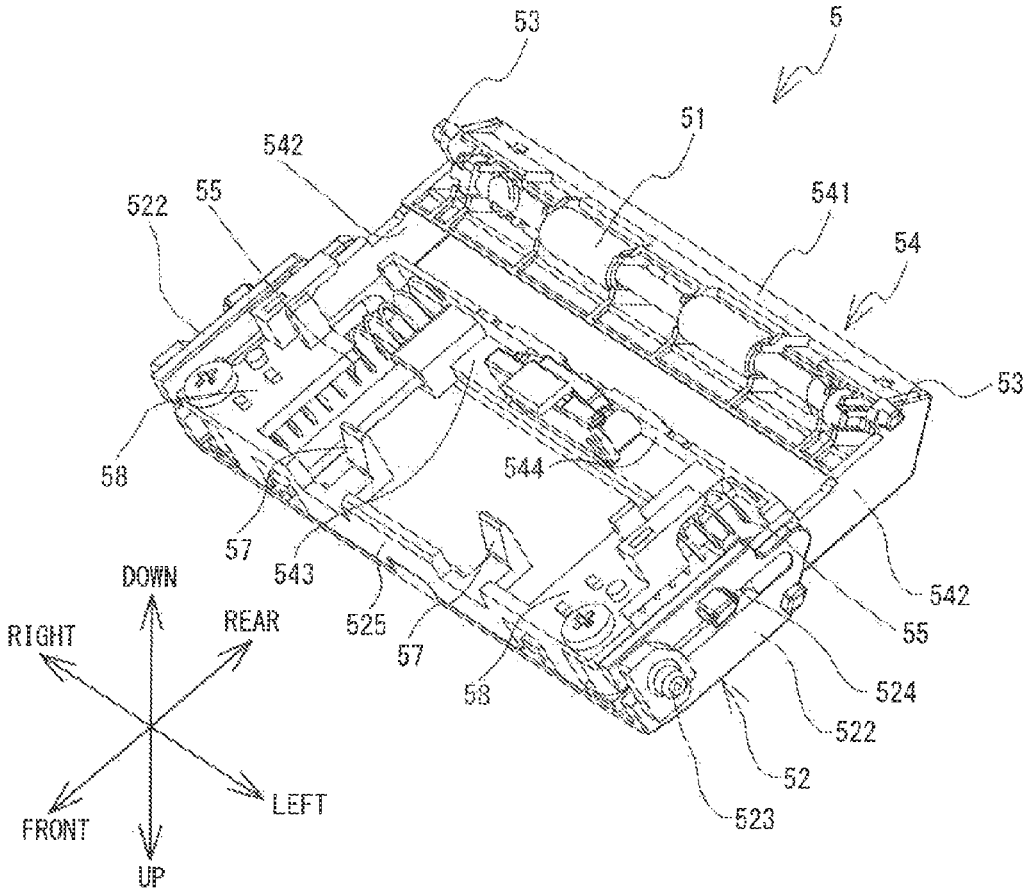
FIG. 7 is an oblique view of the peeling mechanism in which the support member is in the protruding position, as seen from below.

As shown in FIG. 7, the pair of the elastic members 55 are provided close to the left and right ends of the bottom side of the first member 521. In the present embodiment, each one of the pair of the elastic members 55 is a coil spring. Each one of the pair of the elastic members 55 extends from the third member 525 to a fourth member 544 of the support member 54, which is described below. The pair of the elastic members 55 energize a second roller 51, which is described below, toward the rear by energizing the fourth member 544 toward the rear.

Figure 6:
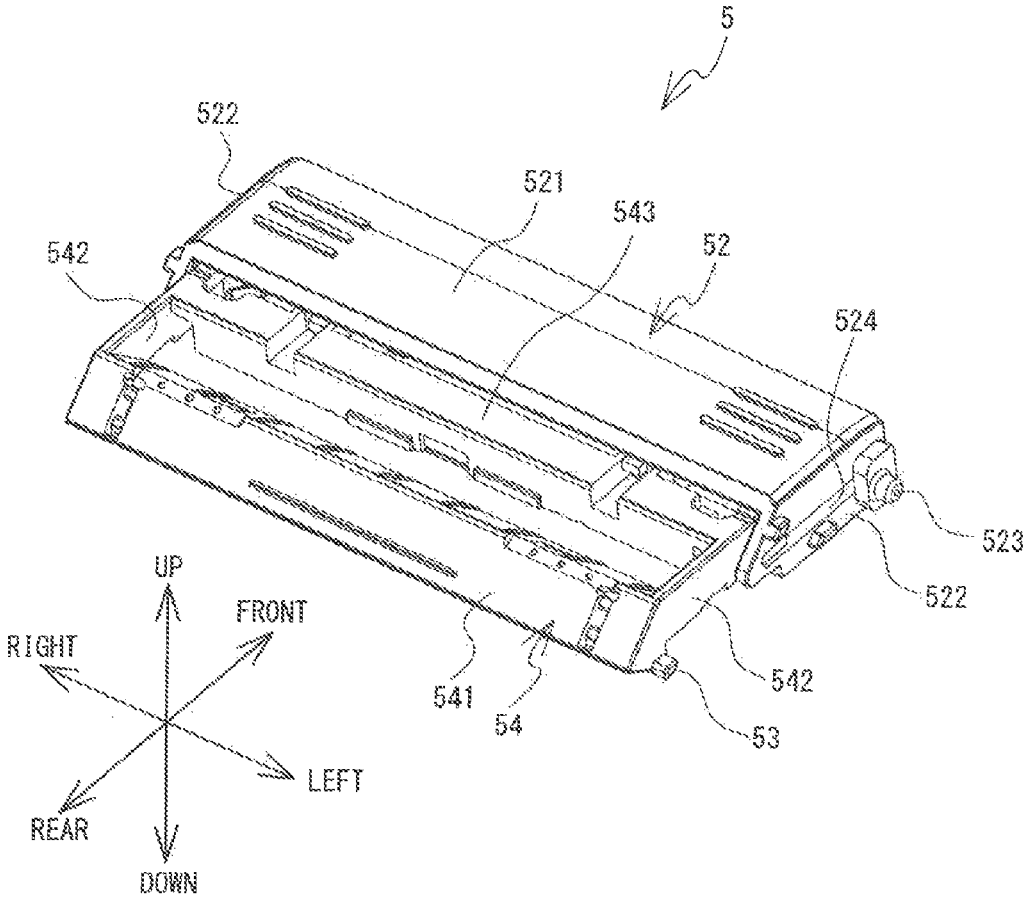
FIG. 6 is an oblique view of the peeling mechanism in which the support member is in a protruding position, as seen from above.

As shown in FIG. 6, the support member 54 is provided with a first member 541, a pair of second members 542, a third member 543, and the fourth member 544 (refer to FIG. 7). The first member 541 extends in the left-right direction. The length of the first member 541 in the left-right direction is slightly shorter than the length of the first member 521 in the left-right direction. Below the first member 541 a space is formed that extends in the left-right direction and is open on its bottom side. As shown in FIGS. 5 and 7, the second roller 51 is provided below the first member 541. The second roller 51 is a circular cylinder, and it extends in the left-right direction.

As shown in FIG. 7, the pair of the second members 542 are plate-shaped members that extend toward the front from the left and right ends of the first member 541. The lengths of the pair of the second members 542 in the front-rear direction are substantially the same as the lengths of the pair of the second members 522 of the frame 52 in the front-rear direction. The left and right ends of the second roller 51 are supported by the rear portions of the corresponding ones of the pair of the second members 542 such that the second roller 51 is able to rotate. A projecting portion (not shown in the drawings) that projects toward the outside in the left-right direction is provided in the front edge portion of the outer side face, facing outside in the left-right direction, of each one of the pair of the second members 542. Each one of the two projecting portions is able to move toward the front and the rear along the corresponding long hole 524. The support member 54 is thus able to move between a stored position in which it is disposed within a space that is enclosed by the first member 521 (refer to FIG. 6) and the pair of the second members 522 (refer to FIGS. 4 and 5) and a protruding position in which it is disposed to the rear of that space (refer to FIGS. 6 and 7). A projecting portion 53 that projects toward the outside is provided in a rear edge portion of the outer side face, facing outside in the left-right direction, of each one of the pair of the second members 542. The projecting portions 53 will be described later.

The third member 543 is bridged between portions, located on the front side from the centers in the front-rear direction, of the pair of the second members 542. The first member 541, the pair of the second members 542, and the third member 543 form an opening on the inner side of the support member 54. The fourth member 544 is provided on the rear edge of the third member 543. The fourth member 544 is a plate-shaped member that extends from the left end to the right end of the third member 543.

A holding mechanism 7 will be explained with reference to FIGS. 8 to 13. The holding mechanism 7 holds the peeling mechanism 5 such that the peeling mechanism 5 can move. As shown in FIG. 9, the holding mechanism 7 is provided with a pair of shaft support portions 71, a pair of second restricting members 73, a pair of support portions 74, and the like.

Figure 8:
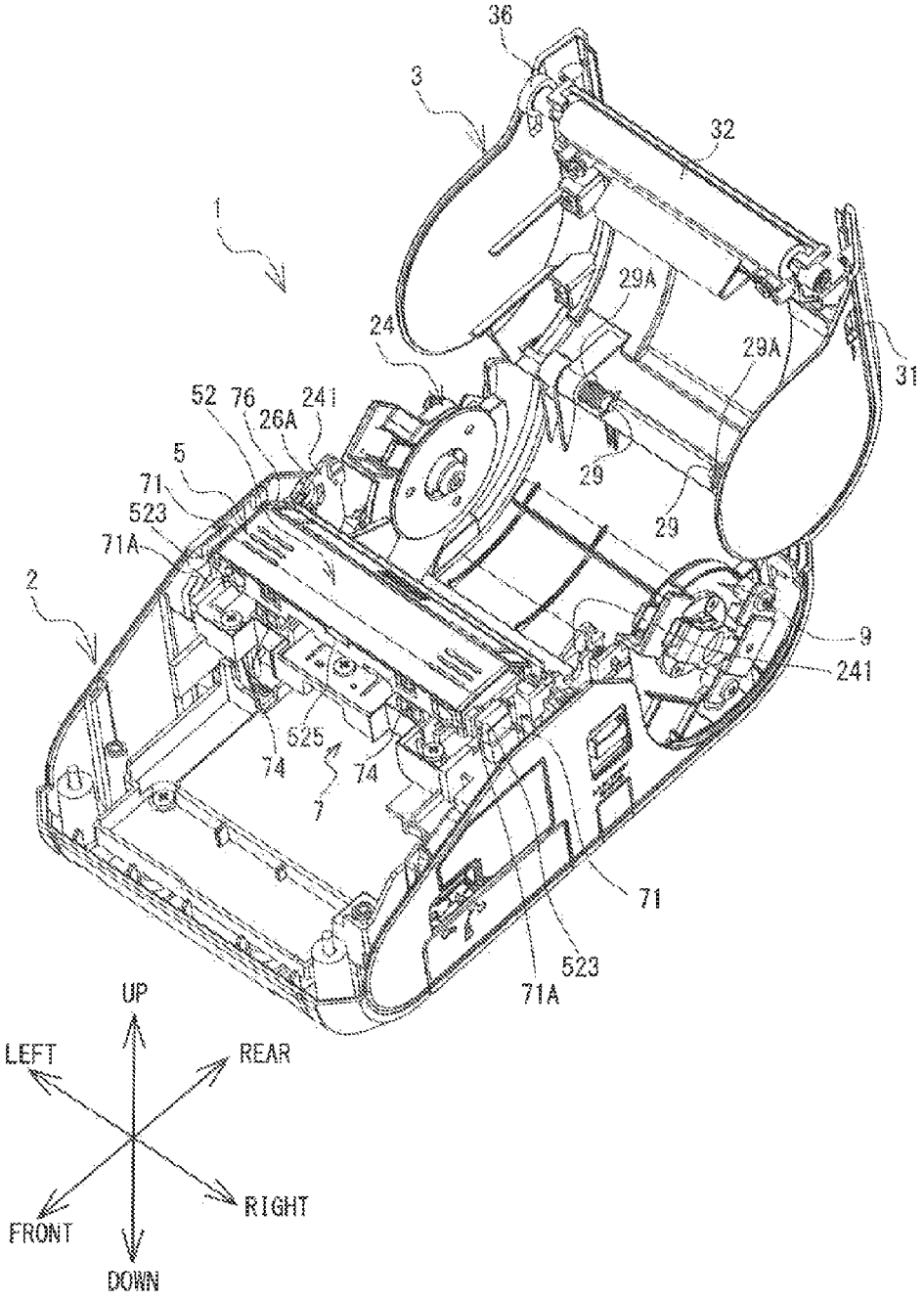
FIG. 8 is an oblique view that shows an internal configuration of the printing device.
Figure 9:
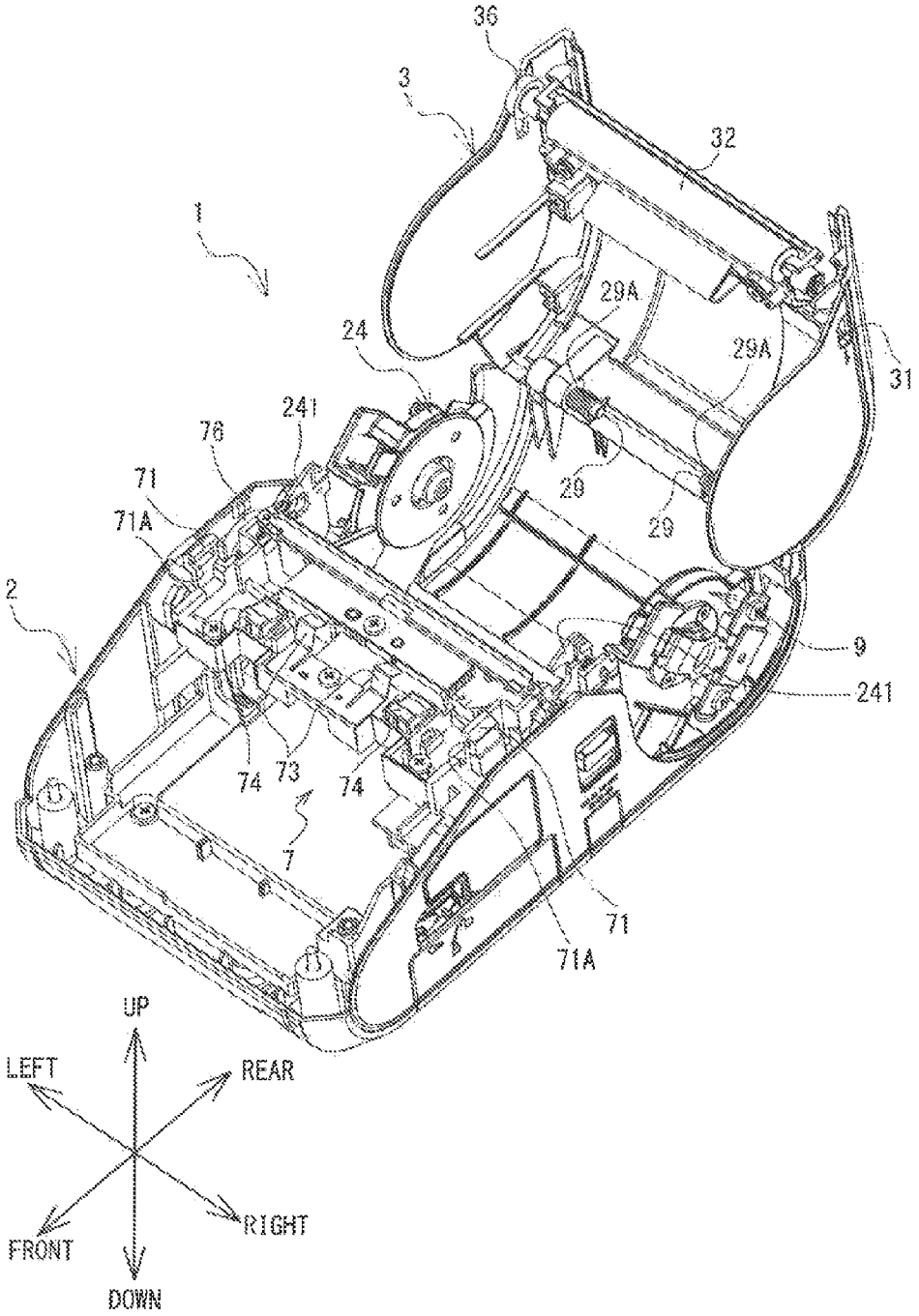
FIG. 9 is an oblique view that shows the internal configuration of the printing device.

As shown in FIG. 8, the pair of the shaft support portions 71 are provided at the left and right ends of the peeling mechanism 5. Each one of the pair of the shaft support portions 71 has a groove 71A that extends in the front-rear direction on the inner side of the shaft support portion 71 in the left-right direction. The shaft portion 523 that is provided on the left side of the frame 52 of the peeling mechanism 5 is inserted into the groove 71A of the shaft support portion 71 on the left side. The shaft portion 523 that is provided on the right side of the frame 52 of the peeling mechanism 5 is inserted into the groove 71A of the shaft support portion 71 on the right side. The movement of the shaft portions 523 along the grooves 71A of the pair of the shaft support portions 71 makes it possible for the peeling mechanism 5 to move toward the front and the rear. Furthermore, the grooves 71A of the pair of the shaft support portions 71 support the shaft portions 523 such that the shaft portions 523 can rotate, making it possible for the rear side of the peeling mechanism 5 to pivot, with the front edge of the peeling mechanism 5 serving as the pivot point. Note that, as will be described in detail later, when the rear side of the peeling mechanism 5 pivots, a sufficient space is required in front of the front edge of the peeling mechanism 5 for the front edge to rotate freely.

Figure 10:
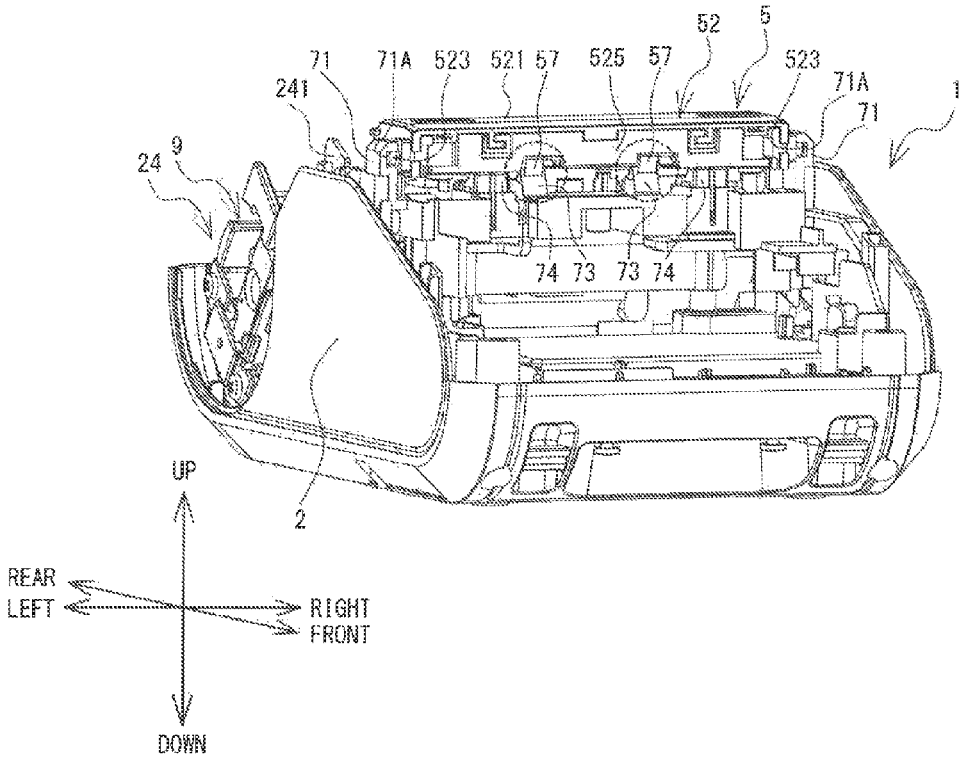
FIG. 10 is an oblique view that shows the internal configuration of the printing device.

As shown in FIGS. 9 and 10, the pair of the second restricting members 73 and the pair of the support portions 74 are provided below the peeling mechanism 5. The pair of the second restricting members 73 are plate-shaped. The second restricting member 73 on the left side extends obliquely upward toward the rear from the right side of the support portion 74 on the left side, then bends downward at its uppermost point and extends downward toward the rear. The second restricting member 73 on the right side extends obliquely upward toward the rear from the left side of the support portion 74 on the right side, then bends downward at its uppermost point and extends downward toward the rear. Each one of the pair of the second restricting members 73 can be elastically deformed downward.

Each one of the pair of the support portions 74 has a rectangular parallelepiped shape with a flat portion and a curved portion on its top face. The support portion 74 on the left side is provided to the left of the second restricting member 73 on the left side. The support portion 74 on the right side is provided to the right of the second restricting member 73 on the right side. As shown in FIG. 10, the top face of the each one of the pair of the support portions 74 is to be in contact with the front edge portion of the bottom face of the third member 525.

Figure 11:
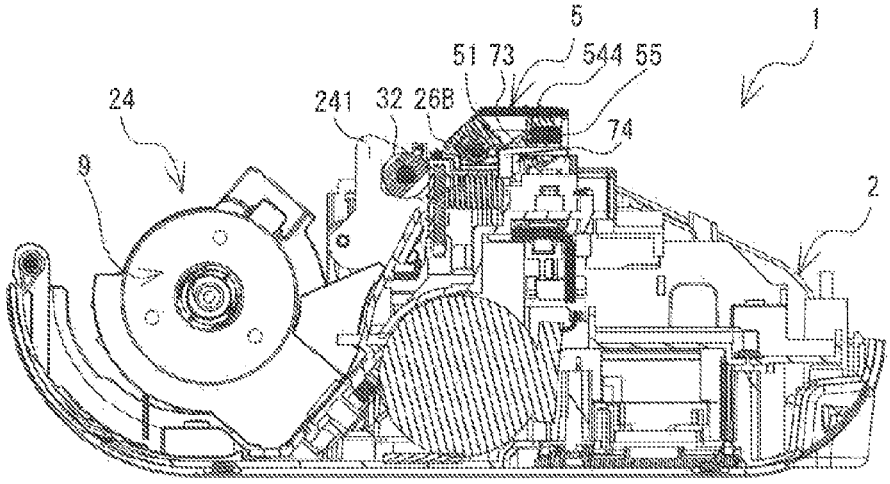
FIG. 11 is a section view along a line XI-XI in FIG. 1.
Figure 11:
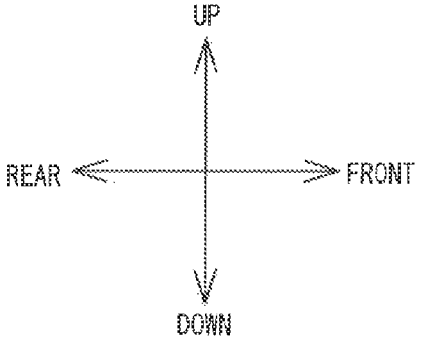

As shown in FIGS. 10 and 11, in a case where the peeling mechanism 5 has been moved toward the front, the upper end of each one of the pair of the second restricting members 73 is disposed on the rear side of the corresponding one of the pair of the anchoring portions 57 and is in contact, from the rear, with the corresponding one of the pair of the anchoring portions 57 and with the fourth member 544. Each one of the pair of the second restricting members 73 restricts the movement of the corresponding one of the pair of the anchoring portions 57 toward the rear. Each one of the pair of the second restricting members 73 restricts the fourth member 544 from being moved toward the rear by the energizing force of the pair of the elastic members 55. The peeling mechanism 5 is held in a state (refer to FIG. 1) in which it has moved until the front edge of the peeling mechanism 5 is in contact with the rear edge of the inclined portion 2A (refer to FIG. 1). Because the peeling mechanism 5 is held in the state in which the front edge of the peeling mechanism 5 is in contact with the rear edge of the inclined portion 2A, the sufficient space is not formed between the inclined portion 2A and the peeling mechanism 5. Rotation of the front edge of the peeling mechanism 5 is therefore inhibited, so the peeling mechanism 5 is held in a state in which the first member 521 is horizontal. Hereinafter, the position of the peeling mechanism 5 in which the rotation of the front edge of the peeling mechanism 5 is inhibited, as shown in FIG. 1, will be called a first position. The state in which the peeling mechanism 5 has moved toward the front, that is, the state of the peeling mechanism 5 in which the support member 54 is in the stored position, the front edge of the peeling mechanism 5 is in contact with the rear edge of the inclined portion 2A (refer to FIG. 1), and the first roller 32 and the second roller 51 are separated will be called a first state.

Figure 12:
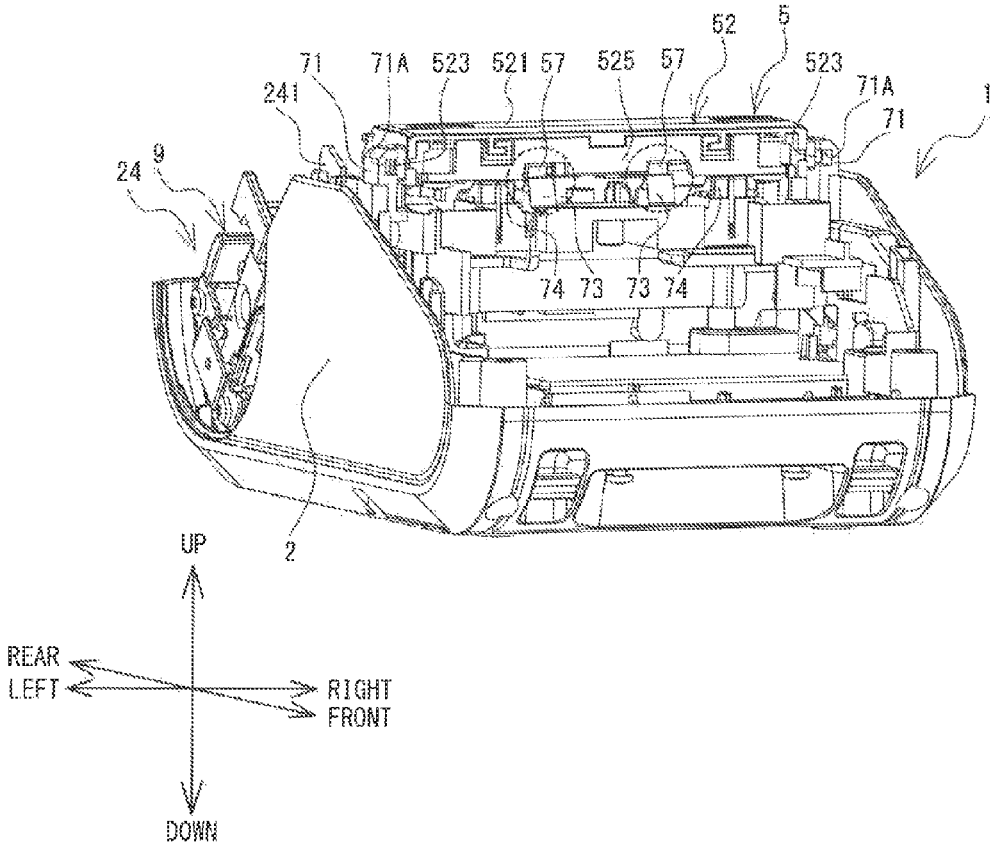
FIG. 12 is an oblique view that shows the internal configuration of the printing device.
Figure 13:
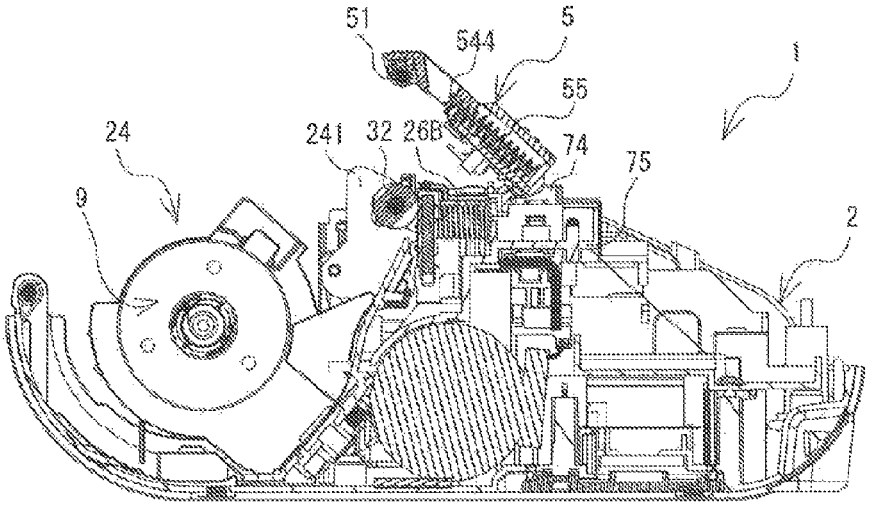
FIG. 13 is a section view along a line XIII-XIII in FIG. 2.
Figure 13:
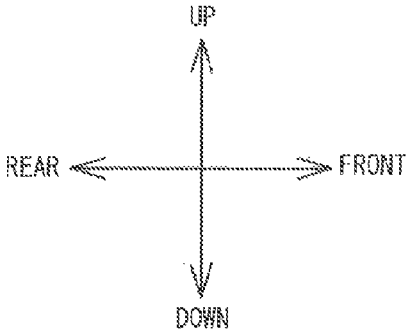

On the other hand, the elastic deformation of each one of the pair of the second restricting members 73 toward the lower side, as shown in FIG. 12, makes it possible for the peeling mechanism 5 to move in the front-rear direction. In that case, the rearward energizing force of the pair of the elastic members 55 on the fourth member 544 ceases to be restricted, as shown in FIG. 7. The fourth member 544 is therefore moved toward the rear by the energizing force of the pair of the elastic members 55. In other words, the support member 54 is switched from the stored position to the protruding position. As shown in FIG. 12, in a case where the peeling mechanism 5 has been moved toward the rear, each one of the pair of the second restricting members 73 comes into contact, from the front, with the corresponding one of the pair of the anchoring portions 57. Each one of the pair of the second restricting members 73 restricts the movement of the corresponding one of the pair of the anchoring portions 57 toward the front. The peeling mechanism 5 is held in a state in which the sufficient space has been formed between the rear edge of the inclined portion 2A (refer to FIG. 1) and the front edge of the peeling mechanism 5. That is, the peeling mechanism 5 is put into a state in which its front edge is able to rotate, unlike in the first state. Hereinafter, the position of the peeling mechanism 5 in which the front edge of the peeling mechanism 5 is able to rotate, as shown in FIG. 12, will be called a second position. As shown in FIG. 13, when the peeling mechanism 5 is in the second position, the rear edge of the peeling mechanism 5 pivots upward, with the front edge serving as the pivot point. In a case where the peeling mechanism 5 pivots, corners on the bottom front side of the peeling mechanism 5 move from the front toward the rear along the curved portions of the top faces of the pair of the support portions 74. Hereinafter, the state of the peeling mechanism 5 in which the support member 54 is in the protruding position, the rear edge of the peeling mechanism 5 has pivoted upward, and the first roller 32 and the second roller 51 are separated, as shown in FIGS. 12 and 13, will be called a second state.

According to the configuration described above, when the peeling mechanism 5 is in the first position, it cannot be switched from the first state to the second state. When the peeling mechanism 5 is in the second position, it can be switched from the first state to the second state. The peeling mechanism 5 is moved from the first position to the second position by canceling the restriction on the rearward movement of the pair of the anchoring portions 57 by the pair of the second restricting members 73.

Figure 14:
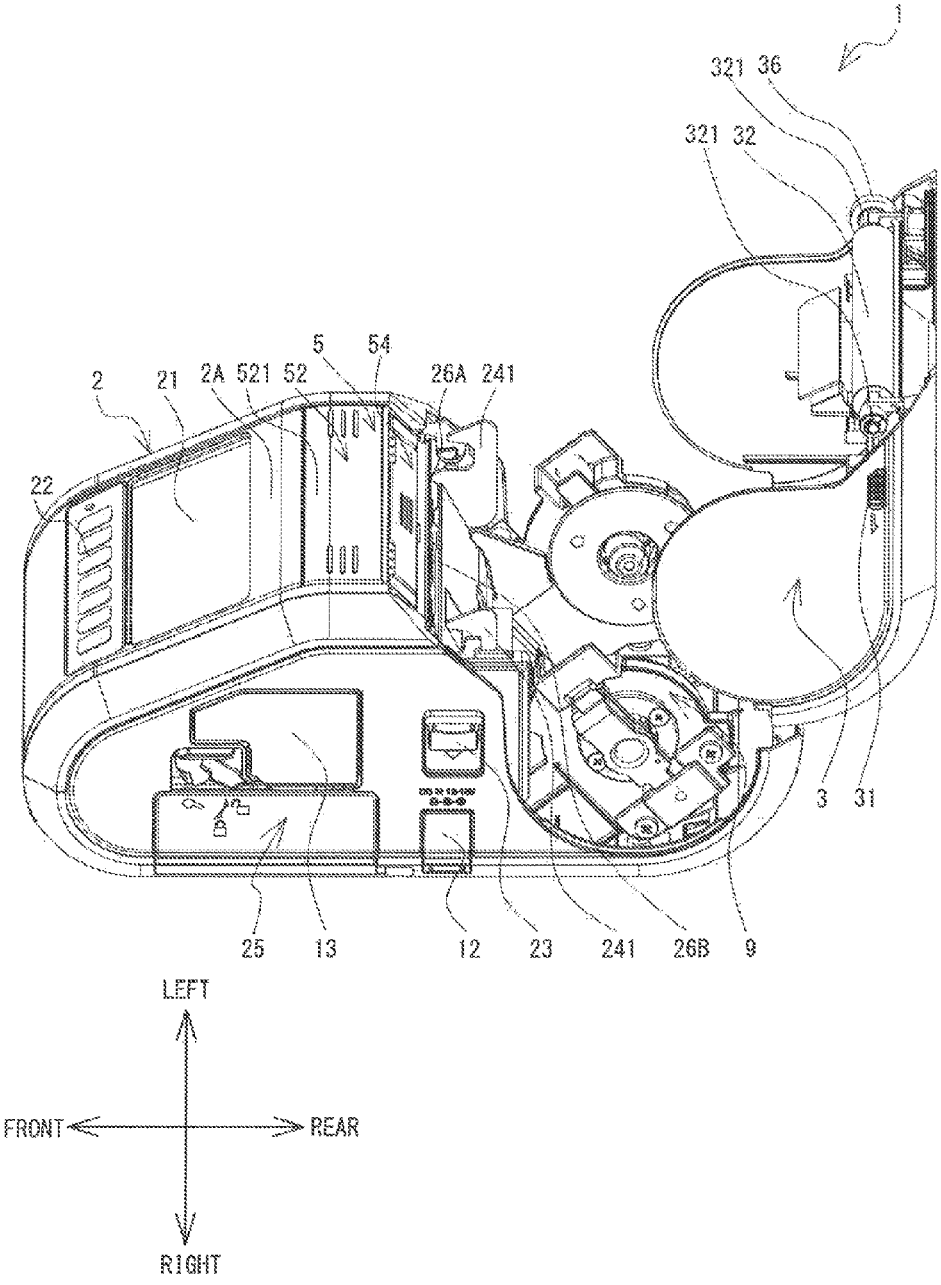
FIG. 14 is an oblique view of the printing device in a first state.

The procedure for operating the printing device 1 in a normal mode with the peeling mechanism 5 in the second state (refer to FIG. 2) will be explained. As shown in FIG. 14, the user pivots the rear edge of the peeling mechanism 5 downward while moving the support member 54 to the stored position by pressing the support member 54 toward the frame 52. With the first member 521 in a horizontal state, the user moves the peeling mechanism 5 toward the front. The front edge of the peeling mechanism 5 comes into contact with the rear edge of the inclined portion 2A. The pair of the second restricting members 73 (refer to FIG. 10) come into contact, from the rear, with the corresponding ones of the pair of the anchoring portions 57 (refer to FIG. 10) and with the fourth member 544 (refer to FIG. 11). The pair of the second restricting members 73 hold the peeling mechanism 5 in the first position and hold the support member 54 in the stored position.

The user closes the lid portion 3 in a state in which the release paper in the leading edge portion of the tape that extends off of the roll is disposed to the rear of the cutting portion 26A and the printing portion 26B. In the closing process, the projecting portions 53 (refer to FIG. 4) do not come into contact with the first guide portions 331 (refer to FIG. 3). The peeling mechanism 5 is therefore not moved by the moving members 331A. As shown in FIG. 1, the printing device 1 is held in the closed state by the engaging of engaging portions 241 (refer to FIG. 2) with the engaged portions 321 (refer to FIG. 2). Note that, in the first state, the first roller 32 and the second roller 51 are separated (refer to FIG. 5).

The user starts the printing with the printing device 1 in the first state and the closed state. The first roller 32 discharges from the discharge outlet 26C the tape that contains the printed heat-sensitive label. Note that the second roller 51 does not come into contact with the discharged tape, so the tape is discharged upward in an extended state. The printed heat-sensitive label is therefore discharged in the state in which it is affixed to the release paper.

The procedure for operating the printing device 1 in a peel-off mode will be explained. The user moves the peeling mechanism 5, which is in the first state, toward the rear. Each one of the pair of the second restricting members 73 (refer to FIG. 12) to be deformed elastically. Then the relative position of the each one of the pair of the second restricting members 73 with respect to the corresponding one of the pair of the anchoring portions 57 (refer to FIG. 12) changes from the front side to the rear side. Each one of the pair of the second restricting members 73 comes into contact with the front side of the corresponding one of the pair of the anchoring portions 57. The peeling mechanism 5 moves from the first position to the second position, and the support member 54 moves from the stored position to the protruding position. The user pivots the rear edge of the peeling mechanism 5 upward, with the shaft portions 523 on the front edge serving as pivot points. Next, the user takes the release paper in the leading edge portion of the tape that extends off of the roll and positions it below the second roller 51.

Figure 15:
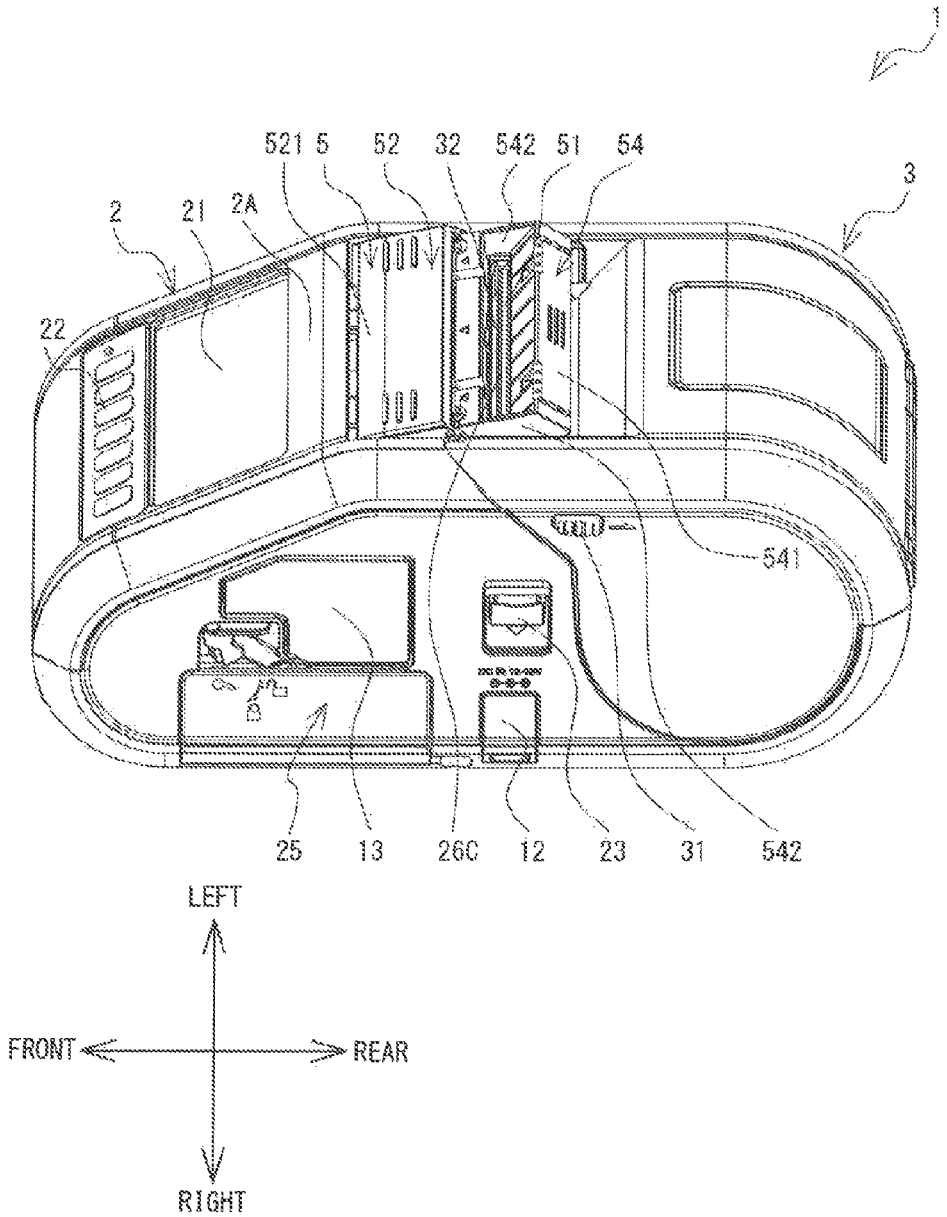
FIG. 15 is an oblique view of the printing device in a third state.

The user closes the lid portion 3. In the closing process, as shown in FIG. 15, the projecting portions 53 (refer to FIG. 7) come into contact with the bottom sides of the moving members 331A (refer to FIG. 3). As the lid portion 3 is gradually closed, the projecting portions 53 move toward the rear along the bottom sides of the moving members 331A. That causes the rear edge of the peeling mechanism 5 to pivot downward, with the shaft portions 523 on the front edge serving as pivot points. The second roller 51 moves downward and gradually approaches the first roller 32 from above.

The printing device 1 is held in the closed state, by the engagement of the engaging portions 241 (refer to FIG. 2) with the engaged portions 321 (refer to FIG. 2). The peeling mechanism 5 is held in a state in which the first member 521 is inclined slightly upward from the horizontal plane toward the rear. The support member 54 enters a state in which it protrudes toward the rear from the frame 52. The second roller 51 is disposed obliquely above and to the rear of the first roller 32. The first roller 32 and the second roller 51 are close to one another in a state in which a small gap is provided between them. Hereinafter, the state of the peeling mechanism 5 when the printing device 1 is in the closed state, the support member 54 is in the protruding position, and the first roller 32 and the second roller 51 are close to one another, as shown in FIG. 15, will be called a third state. The distance between the first roller 32 and the second roller 51 in the third state is shorter than the distance between the first roller 32 and the second roller 51 in the first state and the second state.

In the third state, the user presses downward the support member 54. Each one of the pair of the projecting portions 53 comes into contact with the corresponding one of the pair of the extending portions 332A (refer to FIG. 3) from above. The projecting portions 53 move obliquely downward and toward the rear along the edges of the extending portions 332A. Each one of the projecting portions 53 moves to a position where it comes into contact with the corresponding first restricting member 331B (refer to FIG. 3) and presses the first restricting member 331B toward the rear. The first guide portions 331 move toward the rear against the energizing force of the first energizing portions 331C. Each one of the projecting portions 53 moves to a position where it is lower than the corresponding first restricting member 331B. In a case where, after moving, each one of the projecting portions 53 has separated from the corresponding first restricting member 331B, the corresponding first guide portion 331 is moved toward the front by the energizing force of the corresponding first energizing portion 331C. The bottom end of the corresponding first restricting portion 331B comes into contact with each one of the projecting portions 53 from above then restricts the upward movement of the peeling mechanism 5.

Figure 16:
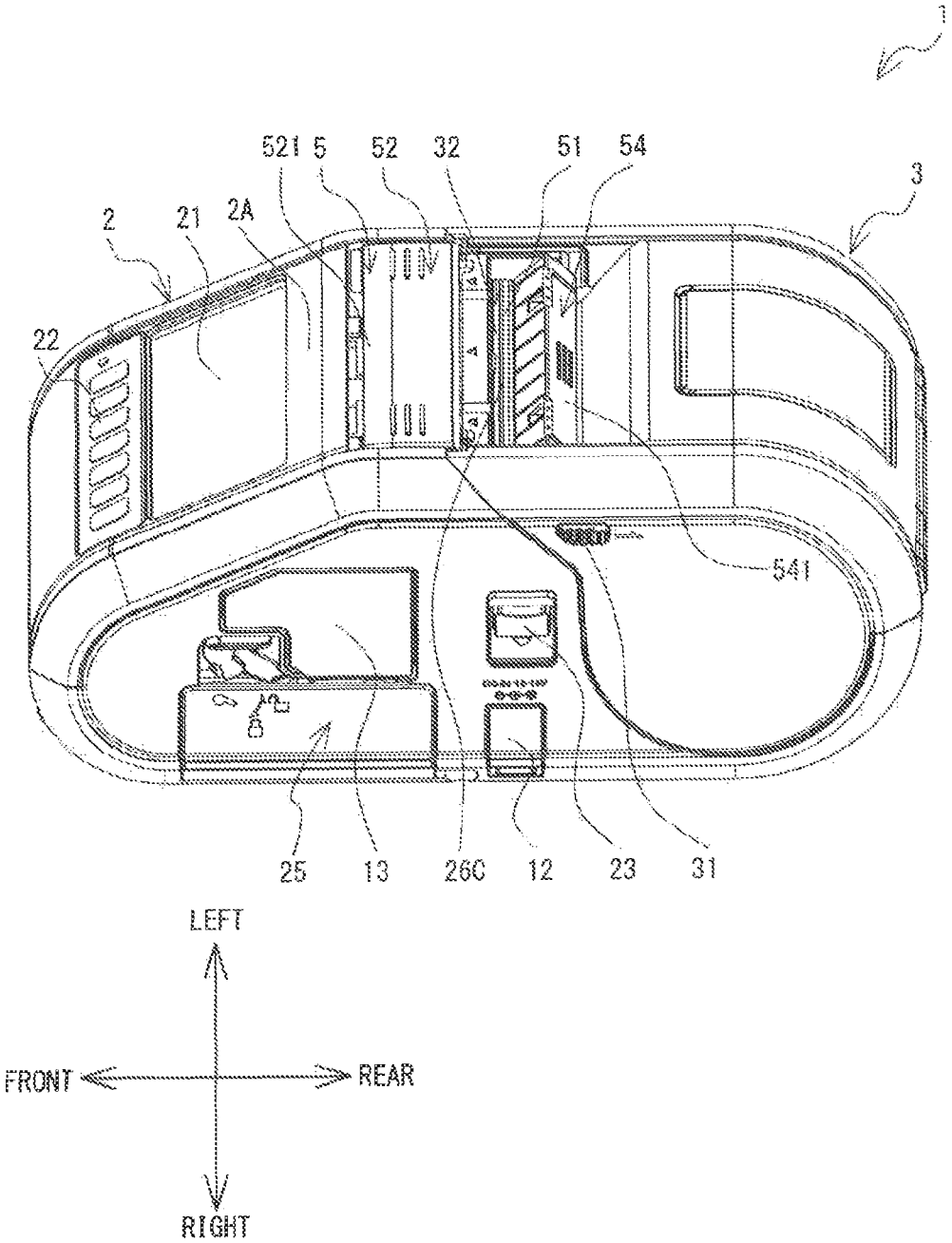
FIG. 16 is an oblique view of the printing device in a fourth state.

In the state in which each one of the projecting portions 53 has moved lower than the corresponding first restricting portion 331B, the second roller 51 faces the first roller 32 obliquely from above and the rear, with the release paper in the leading edge portion of the tape that extends off of the roll being disposed between the first roller 32 and the second roller 51. Hereinafter, the state of the peeling mechanism 5 when the printing device 1 is in the closed state, the support member 54 is in the protruding position, and the first roller 32 and the second roller 51 face one another, as shown in FIG. 16, will be called a fourth state. The distance between the first roller 32 and the second roller 51 in the fourth state is shorter than the distance between the first roller 32 and the second roller 51 in the third state.

The user starts the printing with the peeling mechanism 5 in the fourth state. The printing is performed with the heat-sensitive label in a state of being affixed to the release paper. The release paper is nipped between the second roller 51 and the first roller 32, so the release paper is bent toward the rear and discharged toward the rear. The printed heat-sensitive label is thus peeled off of the release paper and discharged upward from the discharge outlet 26C.

The procedure for opening the lid portion 3 of the printing device 1 when it can operate in the peel-off mode will be explained. The user moves the lever 31 toward the rear. In accordance with the movement of the lever 31, the first guide portions 331 move toward the rear. The first restricting portions 331B move away from the projecting portions 53. The peeling mechanism 5 becomes able to pivot in the direction in which its rear edge moves upward. In accordance with the movement of the lever 31 toward the rear, the peeling mechanism 5 pivots in the direction in which its rear edge moves upward. The projecting portions 53 come into contact with the moving members 331A. The restricting of the movement of the projecting portions 53 by the moving members 331A stops the pivoting of the peeling mechanism 5. The peeling mechanism 5 is switched from the fourth state to the third state and is held in the third state.

The user presses the lever 23 downward, causing the pair of the engaging portions 241 to pivot such that their upper ends move toward the rear. The pair of the engaged portions 321 are thus released from the pair of the engaging portions 241. Note that the energizing portions 29A (refer to FIG. 8) cause energizing forces to act to move the lid portion 3 from the closed state to the open state. The lid portion 3 therefore changes from the closed state to the open state in accordance with the downward pressing of the lever 23. In accordance with the opening of the lid portion 3, the moving members 331A move away from the projecting portions 53. The peeling mechanism 5 pivots in the direction in which the rear edge moves upward, switching the peeling mechanism 5 from the third state to the second state.

As explained above, according to the present embodiment, the energizing of the second roller 51 toward the rear by the elastic members 55 is able to switch the peeling mechanism 5 from the first state to the second state. Therefore, in a case where the user switches the peeling mechanism 5 from the first state to the second state, there is no need to move the second roller 51 to a specified position by a manual operation. Furthermore, the peeling mechanism 5 is switched from the second state to the third state by the closing of the lid portion 3. Therefore, by performing an operation that closes the lid portion 3, the user can put the peeling mechanism 5 into a state in which it can be easily switched from the third state to the fourth state. Therefore, according to the present embodiment, the printing device 1 can be switched easily from the normal mode to the peel-off mode. Furthermore, the switching of the peeling mechanism 5 from the fourth state to the third state can be inhibited by the first restricting members 331B. The printing device 1 is therefore able to use the peeling mechanism 5 in the fourth state to peel the heat-sensitive label off of the release paper properly.

The printing device 1 is provided with the frame 52, the support member 54, and the pair of the elastic members 55. The printing device 1 can therefore utilize the energizing force of the elastic members 55 in switching the support member 54 easily between the stored position and the protruding position. The elastic members 55 energize the support member 54 such that it moves from the stored position to the protruding position. Therefore, by switching the support member 54 to the protruding position and putting the peeling mechanism 5 into the fourth state, the printing device 1 is able to operate in a stable manner in the peel-off mode. By switching the support member 54 to the stored position and putting the peeling mechanism 5 into the first state, the printing device 1 is able to operate in a stable manner in the normal mode.

The printing device 1 is provided with the pair of the second restricting members 73. The pair of the second restricting members 73 restrict the support member 54 from being moved from the stored position to the protruding position by the energizing force of the pair of the elastic members 55. Therefore, in the normal mode, the peeling mechanism 5 is held in the first state. That is, the pair of the second restricting members 73 are able to hold the second roller 51 in a position where it is not in contact with the first roller 32. Therefore, the printing device 1 is able to operate in a stable manner in the normal mode. In restricting the support member 54 from being moved from the stored position to the protruding position by the elastic members 55, the pair of the second restricting members 73 also restrict the peeling mechanism 5 from being moved from the first position to the second position. In other words, the pair of the second restricting members 73 restrict two movement mechanisms. Therefore, in order to switch the peeling mechanism 5 from the first state to the second state, it is sufficient simply to cancel the restricting by the pair of the second restricting members 73. It is therefore easy to switch the peeling mechanism 5 from the first state to the second state. Because only the pair of the second restricting members 73 need to be provided, the printing device 1 can be made more compact.

The pair of the elastic members 55 are coil springs. The coil spring elastic members 55 energize the peeling mechanism 5 in the direction that switches it from the first state to the second state. The printing device 1 is able to use the pair of the coil spring elastic members 55 to switch the peeling mechanism 5 in a stable manner from the first state to the second state.

The printing device 1 is provided with the pair of the elastic members 55 close to the left and right ends of the bottom side of the first member 521. The positioning of the elastic members 55 close to the left and right ends of the bottom side of the first member 521 of the peeling mechanism 5 stabilizes the action of the energizing force of the elastic members 55 on the second roller 51. The printing device 1 is therefore able to switch the peeling mechanism 5 in a stable manner from the first state to the second state. Furthermore, when switching the peeling mechanism 5 from the second state to the first state, the user must move the support member 54 from the protruding position to the stored position by a manual operation. At this time, because the action of the energizing force of the elastic members 55 on the second roller 51 is stable, the printing device 1 is able to switch the peeling mechanism 5 in a stable manner from the second state to the first state.

Figure 17:
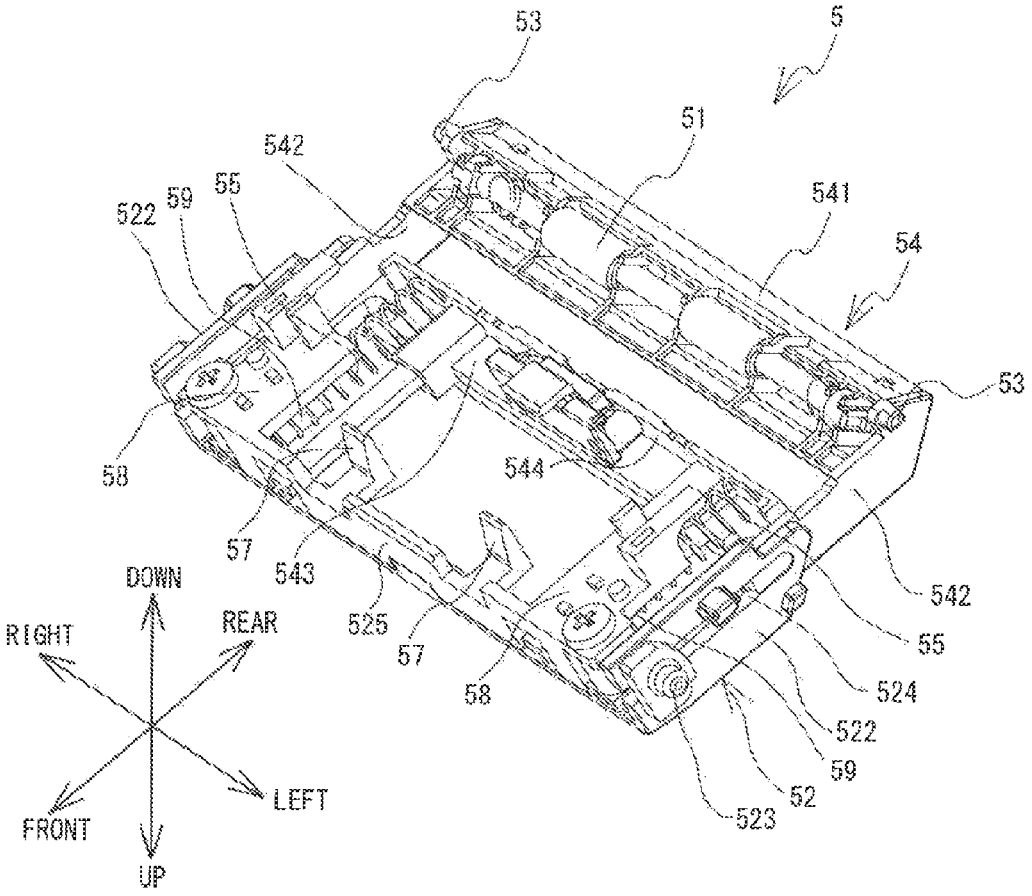
FIG. 17 is an oblique view of the peeling mechanism in a modified example, as seen from below.

Note that the present disclosure is not limited to the embodiment that is described above, and various types of modifications can be made. For example, the printing device 1 may also be provided with a pair of rod members 59. The rod members 59 will be explained with reference to FIG. 17. Except for the presence of the rod members 59, the configuration of the peeling mechanism 5 in the present modified example is the same as in the embodiment that is described above, so the same reference numerals are assigned to the same structural elements as in the embodiment that is described above, and explanations of those elements will be omitted. One of the circular cylindrical rod members 59 is inserted into each one of the pair of the elastic members 55, which are coil springs. The rod members 59 extend toward the rear from the third member 525. The outside diameters of the rod members 59 are smaller than the inside diameters of the pair of the elastic members 55. The lengths of the rod members 59 in the front-rear direction are approximately half the length of the frame 52 in the front-rear direction.

When the rod members 59 are inserted into the elastic members 55, the rod members 59 inhibit the deformation of the elastic members 55 in directions that are orthogonal to the axial direction. The deflection of the pair of the elastic members 55 is therefore stable, so the printing device 1 is able to switch the peeling mechanism 5 in a stable manner from the first state to the second state. Furthermore, because the rod members 59 have been inserted into the pair of the elastic members 55, when the peeling mechanism 5 is switched from the second state to the first state, forces in the axial direction are transmitted more easily to the pair of the elastic members 55 than would be the case if the rod members 59 were not inserted into the pair of the elastic members 55. The printing device 1 is therefore able to switch the peeling mechanism 5 in a stable manner from the second state to the first state.

In the embodiment that is described above, the pair of the second restricting members 73 restrict the support member 54 from being moved from the stored position to the protruding position by the pair of the elastic members 55, and they also restrict the peeling mechanism 5 from being moved from the first position to the second position. However, the present disclosure is not limited to this configuration. For example, the members that restrict the support member 54 from being moved from the stored position to the protruding position and the members that restrict the peeling mechanism 5 from being moved from the first position to the second position may also be separate members.

The elastic members 55 are not limited to being coil springs, and various types of modified shapes, such as flat springs or the like, can also be used. It is also acceptable for the printing device 1 to be provided with at least one elastic member instead of with the pair of the elastic members 55.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printing device configured to perform printing on a label affixed to a release paper, the printing device comprising:

a body portion provided with a storing portion configured to accommodate the release paper to which the label is affixed;

a lid portion supported by the body portion, the lid portion being able to open and close the storing portion;

a first roller rotatably supported by the lid portion;

a peeling mechanism including a second roller and a projecting portion, the second roller being configured to peel the label off of the release paper by nipping the release paper against the first roller, the projecting portion being provided to project toward an outside, the peeling mechanism being supported by the body portion such that a position of the second roller in relation to the first roller changes as the projecting portion moves; and a guide portion provided in the lid portion, the guide portion being provided with a moving portion and a first restricting portion, the moving portion being configured to move the projecting portion by coming into contact with the projecting portion in a closing process in which the lid portion changes from an open state to a closed state, and the first restricting portion being configured to restrict the projecting portion from moving when the first restricting portion is in contact with the projecting portion in the closed state, wherein the peeling mechanism is configured to be set selectively to a first state, a second state, a third state, and a fourth state, the first state being a state in which the second roller is separated from the first roller and the projecting portion is unable to come into contact with the moving portion in the closing process, the second state being a state in which the second roller is separated from the first roller and the projecting portion is able to come into contact with the moving portion in the closing process, the third state being a state in which a distance between the first roller and the second roller is shorter than the distance between the first roller and the second roller in the first state and the second state, and the fourth state being a state in which the distance between the first roller and the second roller is shorter than the distance between the first roller and the second roller in the third state, the peeling mechanism further includes an elastic member configured to energize the second roller in a direction to switch the peeling mechanism from the first state to the second state, the moving portion is configured to switch the peeling mechanism from the second state to the third state by separating from the projecting portion in the open state and coming into contact with the projecting portion in the closing process, and the first restricting portion is configured to restrict the peeling mechanism from switching from the fourth state to the third state, by coming into contact with the projecting portion and restricting the projecting portion from moving when the peeling mechanism is in the fourth state.

2. The printing device according to claim 1, wherein the peeling mechanism is further provided with a frame portion and a support member, the frame portion being supported by the body portion, and the support member rotatably supporting the second roller and being able to move between a stored position, in which the second roller is stored in the frame portion, and a protruding position, in which the second roller protrudes from the frame portion, the support member is in the stored position in the first state, the support member is in the protruding position in the second state, and the elastic member is configured to energize the support member from the stored position toward the protruding position.

3. The printing device according to claim 2, further comprising:

a second restricting portion configured to restrict the support member from moving from the stored position toward the protruding position by energizing force of the elastic member.

4. The printing device according to claim 3, wherein the second restricting portion is affixed to the body portion such that, when the support member is in the stored position, the second restricting portion comes into contact with a first contacted member of the support member while being disposed in a position closer to the protruding position than the first contacted member, and the second restricting portion is configured to elastically deform as the support member moves toward the protruding position.

5. The printing device according to claim 4, wherein the frame portion is supported by the body portion such that the peeling mechanism can move between a first position, where the peeling mechanism is unable to switch from the first state to the second state, and a second position, where the peeling mechanism is able to switch from the first state to the second state, and the second restricting portion is configured to restrict the peeling mechanism from moving from the first position to the second position, by coming into contact with a second contacted member of the frame portion while being disposed in a position closer to the second position than the second contacted member when the peeling mechanism is in the first position.

6. The printing device according to claim 2, further comprising:

a second restricting portion configured to restrict the peeling mechanism from moving from a first position to a second position, the first position being a position of the frame portion in which the peeling mechanism is unable to switch from the first state to the second state, and the second position being a position of the frame portion in which the peeling mechanism is able to switch from the first state to the second state.

7. The printing device according to claim 6, wherein the second restricting portion is affixed to the body portion such that, when the peeling mechanism is in the first position, the second restricting portion restricts the peeling mechanism from moving from the first position to the second position by coming into contact with a contacted member of the frame portion while being disposed in a position closer to the second position than the contacted member.

8. The printing device according to claim 1, wherein the peeling mechanism further includes a rod-shaped portion provided to be inserted into a coil spring, and the elastic member is the coil spring into which the rod-shaped portion is inserted.

9. The printing device according to claim 8, wherein the peeling mechanism is provided with two of the rod-shaped portion and two of the elastic member, one of the two rod-shaped portions and one of the two elastic members into which the one of the two rod-shaped portions is inserted are provided in a position close to one end portion, in an axial direction, of the peeling mechanism, the axial direction being a direction in which a rotational axis of the second roller extends, and another one of the two rod-shaped portions and another one of the two elastic members into which the another one of the two rod-shaped portions is inserted are provided in a position close to another end portion, in the axial direction, of the peeling mechanism.

* * * * *